US009593511B2

(12) United States Patent
Hunt

(10) Patent No.: US 9,593,511 B2
(45) Date of Patent: Mar. 14, 2017

(54) LOCK FOR A MOTOR VEHICLE

(71) Applicant: Kiekert AG, Heiligenhaus (DE)

(72) Inventor: Robert J. Hunt, Davisburg, MI (US)

(73) Assignee: Kiekert AG, Heiligenhaus (DE)

( * ) Notice: Subject to any disclaimer, the term of this patent is extended or adjusted under 35 U.S.C. 154(b) by 226 days.

(21) Appl. No.: 13/851,461

(22) Filed: Mar. 27, 2013

(65) Prior Publication Data

US 2014/0291997 A1 Oct. 2, 2014

(51) Int. Cl.

*E05C 3/16* (2006.01)
*E05B 77/06* (2014.01)
*E05B 85/26* (2014.01)

(52) U.S. Cl.

CPC ..... *E05B 77/06* (2013.01); *E05B 85/26* (2013.01); *Y10T 292/0908* (2015.04)

(58) Field of Classification Search

CPC ..... E05B 77/02; E05B 77/04; E05B 77/06; E05B 77/12; E05B 85/26
USPC ..... 292/194, 195, 198, 200, 217, DIG. 22, 292/DIG. 65, 201, 216, DIG. 23
See application file for complete search history.

(56) References Cited

U.S. PATENT DOCUMENTS 5,634,677 A 6/1997 Buscher et al.
5,865,481 A * 2/1999 Buschmann ..... 292/216
5,921,595 A 7/1999 Brackmann et al.
5,961,163 A 10/1999 Brackmann et al.
6,382,687 B1 5/2002 Gruhn
6,406,073 B1 6/2002 Watanabe
6,791,688 B2 * 9/2004 Lai et al. ..... 356/417
6,824,177 B1 11/2004 Nass et al.
6,971,688 B2 * 12/2005 Drysdale ..... E05B 77/06 292/216
6,991,272 B2 * 1/2006 Kalsi ..... 292/336.3
7,926,858 B2 4/2011 Otsuka
2001/0024040 A1 9/2001 Spurr
2002/0167178 A1 11/2002 Spurr et al.
2008/0224482 A1 9/2008 Cumbo et al.
2009/0322105 A1 * 12/2009 Lee et al. ..... 292/237
2010/0052336 A1 * 3/2010 Bendel et al. ..... 292/196

(Continued)

FOREIGN PATENT DOCUMENTS

DE 102011010797 A1 * 8/2012
DE 102011010815 A1 * 8/2012

(Continued)

*Primary Examiner* — Alyson M Merlino
(74) *Attorney, Agent, or Firm* — Renner, Otto, Boisselle & Sklar, LLP

(57) ABSTRACT

A lock with a locking mechanism comprises a rotary catch, a pawl for engaging the rotary catch, a blocking lever capable of blocking the pawl if the latter is located in its catching position, and a releasing lever for opening or releasing the locking mechanism. When the releasing lever is actuated, the pawl and, if applicable, the blocking lever is moved out of its blocking position provided that the releasing lever is moved in a usual manner and the releasing lever is not exposed to increased or excessive accelerations. In case of an increased or excessive acceleration of the releasing lever such as caused by a crash or impact, an arresting device prevents the releasing lever from disengaging the pawl and optionally the blocking lever of the pawl. The arresting device is further releasable with the return of the releasing lever to the initial rest position.

12 Claims, 3 Drawing Sheets

(56) References Cited

U.S. PATENT DOCUMENTS

| | | | | |
|---|---|---|---|---|
| 2011/0210565 | A1* | 9/2011 | Scholz et al. | 292/200 |
| 2014/0001774 | A1* | 1/2014 | Bendel et al. | 292/200 |
| 2014/0035295 | A1* | 2/2014 | Bendel et al. | 292/100 |
| 2014/0049056 | A1 | 2/2014 | Scholz et al. | |
| 2014/0132008 | A1* | 5/2014 | Bendel et al. | 292/92 |
| 2014/0203575 | A1* | 7/2014 | Brickner et al. | 292/341.17 |

FOREIGN PATENT DOCUMENTS

| | | | |
|---|---|---|---|
| DE | 102011010816 | A1 * | 8/2012 |
| DE | 102013203808 | A1 * | 9/2014 |
| EP | 1518983 | A2 * | 3/2005 |

* cited by examiner

LOCK FOR A MOTOR VEHICLE

BACKGROUND OF THE INVENTION

The invention relates to a lock for a motor vehicle.

A lock for a motor vehicle comprises a locking mechanism with a rotatably mounted rotary catch for receiving a locking bolt also known as a striker. The locking mechanism moreover comprises a pawl with which the rotary catch may engage for retaining the locking bolt.

The rotary catch of a motor vehicle lock usually comprises a fork-shaped inlet slot (also known as inlet opening) which is formed by the load arm and the rotary catching arm and in which the striker of a vehicle door or hatch, e.g. a hood or a trunk lid, enters when the door or hatch is closed. The locking bolt or striker then turns the rotary catch from an opened position in the direction of the closed position until the pawl engages the rotary catch. This position is referred to as the catching position, also known as fully close stop, in which the locking bolt is retained in the inlet slot of the rotary catch.

In addition, a lock may comprise a blocking lever capable of blocking the pawl in its catching position. The blocking lever has to be pivoted or turned out of its blocking position in order for the pawl to be able to leave its catching position for opening the locking mechanism.

There are locks known in the art (US 2010 052 336 A1) in which the rotary catch is capable of introducing an opening moment into the pawl if the latter is in its catching position. Such a lock requires a blocking lever in order to be able to engage the locking mechanism. These locks facilitate the opening of the locking mechanism.

There are also motor vehicle locks with two catching positions, i.e. a preliminary catching position, also known as intermediate close stop, and a main catching position or fully close stop. The preliminary catching position enables a first catching of a corresponding door or hatch when the latter does not reach the main catching position during a closing procedure. When, starting from the preliminary catching position, the rotary catch is rotated further, the main catching position may be reached.

Generally, a lock comprises a releasing lever which is actuated in order to open or disengage a locking mechanism. Such a releasing lever is typically connected to a handle of a door or hatch. If the handle is operated, the releasing lever is actuated or pivoted correspondingly in order to disengage the locking mechanism and thus open the lock.

In the event of a crash or impact, the handle may be actuated in an unintended manner, which could lead to an unintended opening of the locking mechanism. It should be ensured that such a lock does not open under these circumstances.

In order to prevent an unintended opening of a lock in the event of a crash, a known lock (EP 1 518 983 A2) with a locking mechanism comprises at least one actuating lever for releasing or opening the locking mechanism, i.e. a releasing lever. The lock moreover comprises a blocking lever which blocks the actuating lever during predetermined vehicle accelerations.

In the event of a crash, excessive accelerations may occur when compared with an usual opening procedure. If the actuating lever only blocks at large vehicle accelerations, such as they occur in the event of a crash, an unintended opening of the locking mechanism in the case of a crash can be prevented. In case of an usual actuation of the door handle, the actuating lever is not blocked due to the lack of increased acceleration so that the lock can then be opened.

SUMMARY OF THE INVENTION

The invention provides a lock for a motor vehicle that prevents an unintended opening, especially in connection with crashes or impacts. More generally, there is a need for a more reliable lock without adversely affecting the functioning of the lock under normal circumstances.

In an embodiment, a lock with a locking mechanism is provided which comprises a rotary catch and a pawl for engaging the rotary catch. The lock may comprise a blocking lever capable of blocking the pawl if the latter is located in its catching position. Moreover, a releasing lever for opening or releasing the locking mechanism is provided. When the releasing lever is actuated, the pawl and, if applicable, the blocking lever is moved out of its blocking position provided that the releasing lever is moved in an usual manner and the releasing lever is not exposed to increased or excessive accelerations. In case of an increased or excessive acceleration of the releasing lever such as caused by a crash or impact, an arresting device of the lock prevents the releasing lever from disengaging the pawl and optionally the blocking lever of the pawl. The arresting device is further releasable with the return of the releasing lever to the initial rest position. Accordingly, the lock is blocked from unintended opening when the releasing lever is moved with an increased or excessive acceleration such as during a crash or an impact of the vehicle.

In an embodiment, the arresting device comprises an inertia lever. The inertia lever and the releasing lever are interconnected in such a way that the inertia lever is moved by the releasing lever only when the releasing lever is accelerated in the usual manner, as is the case when the door handle is actuated in the usual way, for example, by a driver of the vehicle. During normal operation, the substantially joint movement of the inertia lever and the releasing lever is such that the arresting device does not inhibit the opening of the locking mechanism by the releasing lever. When the releasing lever is exposed to increased or excessive accelerations such as in connection with a crash or impact, the releasing lever and the inertia lever move as separate members due to an inertia effect between the components. Accordingly, the arresting device inhibits the opening of the locking mechanism, in particular by blocking the movement of the pawl.

In an embodiment, the arresting device comprises a spring which interconnects the inertia lever and the releasing lever in such a way that the inertia lever is moved by the releasing lever only when the releasing lever is accelerated in the usual manner. This establishes a rigidly coupled connection between the inertia lever and the releasing lever in a simplified way when the releasing lever is accelerated in an usual manner. The term "accelerated in an usual manner" means that there is no increased or excessive acceleration such as caused by a crash or impact.

In an embodiment, one leg of the spring is connected to the inertia lever. In particular, such a connection is provided when the leg of the spring rests against a contour of the inertia lever, preferably in a biased manner. The contour of the inertia lever may be provided by a projection or recess of the inertia lever. Another leg of the spring is connected to the releasing lever. In particular, such a connection is provided when the leg of the spring rests against a contour of the releasing lever, preferably also in a biased manner. The contour of the releasing lever may be provided by an edge portion of the releasing lever. In case of normal accelerations, the spring arrangement acts as a rigid connection between the releasing lever and the inertia lever.

Thus, an actuation of the releasing lever leads to a corresponding movement of the inertia lever whereby the locking mechanism can be opened. The actuation of the releasing lever is generally realized by actuation of a handle or grip of the corresponding door or flap.

In an embodiment, the inertia lever is configured to block the pawl for preventing the disengagement of the locking mechanism. In particular, the pawl is blocked via a contour of the inertia lever which may act as a stopper for the pawl. This enables the blocking of the pawl without the provision of a separate blocking lever thereby reducing the components and realizing the arresting device in a compact and spaceoptimised manner.

In an embodiment, the arresting device comprises a safety lever for blocking the inertia lever. Preferably the safety lever is biased in the blocking direction, for example, using a preloaded spring. The safety lever is arranged in such a way that the safety lever blocks a further movement of the inertia lever when the releasing lever is moved with an increased or excessive acceleration.

In an embodiment, the safety lever is configured for engagement with the releasing lever, preferably via an arm of the releasing lever. The safety lever may be released from the blocking position by a corresponding movement of the releasing lever, especially the lever arm, engaging with a portion of the safety lever. The safety lever may comprise a pin for engagement with the releasing lever thereby providing an interface between the safety lever and the arm of the releasing lever.

In case of increased or excessive acceleration of the releasing lever, the spring is deformed but the inertia lever substantially maintains its position due to inertia. The spring may also be biased further in case of a correspondingly large acceleration. In particular, the biased safety lever may move into the blocking position due to the movement of the releasing lever to prevent a further movement of the inertia lever. In the blocking position of the safety lever, the inertia lever is inhibited from any further movement in such a way that an opening of the locking mechanism is prevented, especially by blocking the pawl of the locking mechanism with the inertia lever.

In an embodiment, the mass of the inertia lever is larger than the mass of the spring, preferably several times larger, in order to realize a sufficient inertia effect so that the inertia lever stays stationary when the releasing lever is exposed to increased or excessive accelerations.

In an embodiment, the releasing lever and the safety lever are arranged such that the interface between both has a gap when the safety lever is in the blocking position. In particular, the gap is dimensioned to allow a predetermined movement of the releasing lever without adversely affecting the safety lever in its blocking position. Thus, a secure and reliable blocking of the inertia lever is maintained even when the releasing lever is exposed to bouncing movement due to subsequent impacts in case of a crash. Accordingly, the provision of the gap enables a more reliable blocking position of the safety lever.

In an embodiment, the inertia lever comprises a notch or recess for engagement with the safety lever. The notch may be provided on one end of the inertia lever and in particular in extension of the contour which acts as a stopper for the pawl. The notch or recess facilitates a secure blocking of the inertia lever by the safety lever.

In an embodiment, the arresting device is configured such that the safety lever does not reach the blocking position when the releasing lever is accelerated in the usual manner, especially with normal acceleration. The engagement between the releasing lever and the safety lever may be configured such that when the releasing lever is moved with normal acceleration, the safety lever does not reach the blocking position of the inertia lever, thereby allowing an opening of the locking mechanism. Preferably the safety lever is biased in the direction of the blocking position, for example, by a preloaded spring. When the releasing lever is exposed to an increased or excessive acceleration, the movement of the safety lever in conjunction with the basically stationary inertia lever results in the safety lever engaging in the blocking position of the inertia lever, thereby preventing an opening of the locking mechanism.

In an embodiment, the safety lever is releasable from the blocking position by engagement with the releasing lever and in particular the arm of the releasing lever which is moved to the initial rest position of the releasing lever.

In an embodiment, the lock may comprise a further blocking lever for blocking the pawl in its arresting position. In this case, the release lever may actuate a pin or catch of the blocking lever in order to disengage the blocking lever from its blocking position.

In an embodiment, the release lever may act as a pawl in order to engage the rotary catch in its preliminary or main catching position.

BRIEF DESCRIPTION OF THE DRAWINGS

For a better understanding of the invention, reference should be made to the detailed description of the invention below, in conjunction with the following drawings in which like reference numerals refer to corresponding parts throughout the figures.

DETAILED DESCRIPTION OF THE INVENTION

Figure 1:
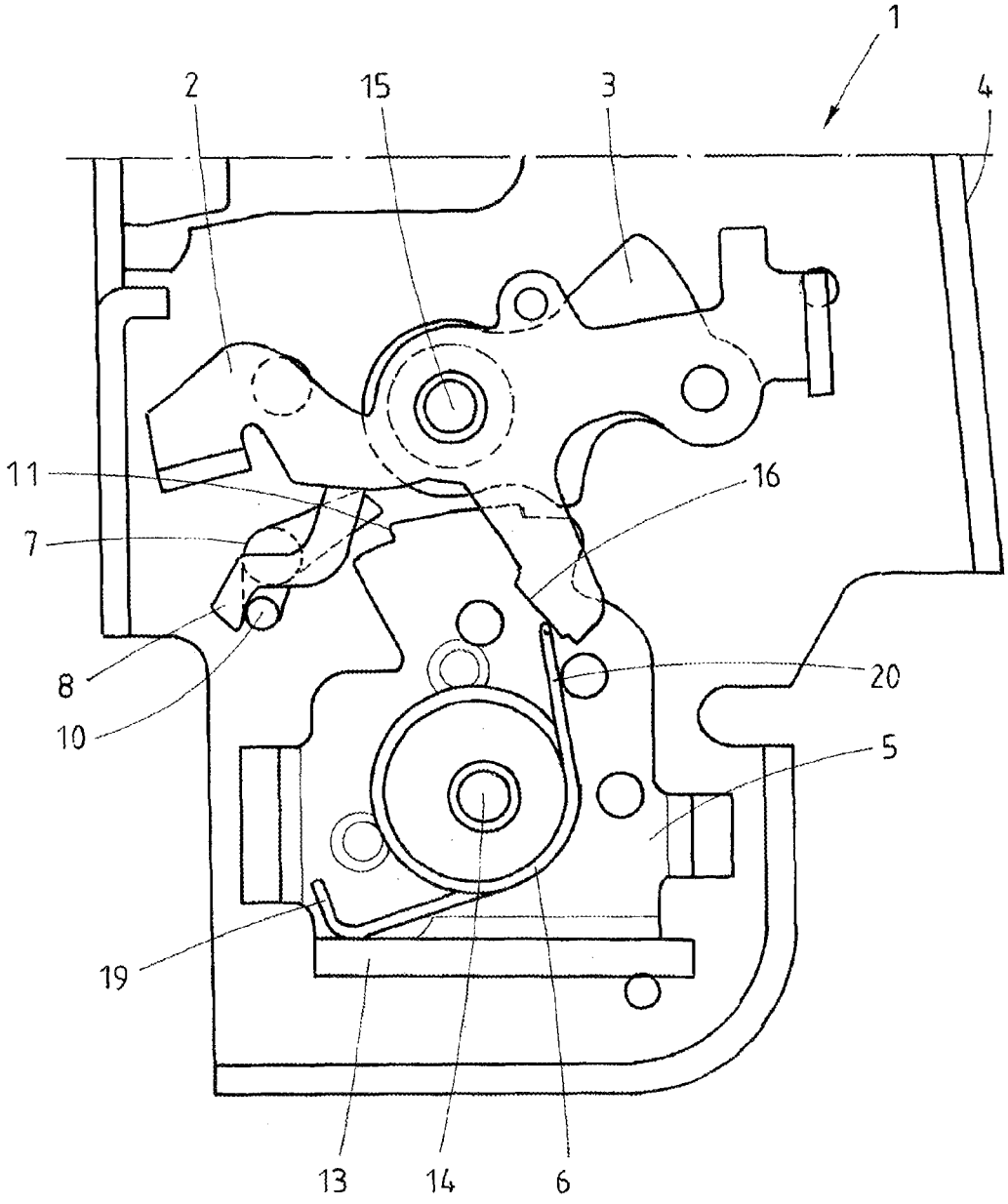
FIG. 1 illustrates a schematic view of a locking mechanism in a rest position according to an embodiment of the invention.

FIG. 1 illustrates a motor vehicle lock 1, according to an embodiment of the invention. The locking mechanism of the lock 1 comprises a pawl 3, a safety lever 7, an inertia lever 5 and a spring 6. The pawl 3, the inertia lever 5 and the safety lever 7 may be rotatably mounted on a metal plate 4. In addition, there is a releasing lever 2. The releasing lever 2 may be arranged above the pawl 3 and may be rotatably mounted on an axis 15.

The pawl 3 may also rotate around the axis 15. The inertia lever 5 may rotate around its axis 14. The weight of the inertia lever 5 may be higher than the weight of the spring 6.

The pawl 3 may block an opening rotation, in this case in clockwise direction, of a rotary catch (not shown). In FIG. 1, the pawl 3 is shown in its catching position. In order to unlock the locking mechanism, the pawl 3 has to be rotated in clockwise direction. When the pawl 3 has been moved out of its catching position, the rotary catch may be rotated clockwise in the direction of its opened position. When the rotary catch arrives at its opened position, a striker of a vehicle door or vehicle flap may leave the locking mechanism, thereby allowing the opening of a corresponding door or flap.

The safety lever 7 is rotatably mounted on the axis 12. The safety lever 7 may comprise a pin 10 for engagement with the releasing lever 2 and in particular an arm 8 of the releasing lever 2. The pin 10 may extend parallel to the axis 12 so that an interface between the safety lever 7 and the arm 8 of the releasing lever 2 is provided. The safety lever 7 may be arranged adjacent to one end of the inertia lever 5. In addition, the safety lever 7 and inertia lever 5 may be configured such that the inertia lever 5 can be blocked by the safety lever 3. Accordingly, the inertia lever 5 may comprise a notch 11 or recess on one end of the inertia lever 5 in order to facilitate a reliable blocking. The blocking of the inertia lever 5 is explained in detail in connection with FIG. 3.

The releasing lever 2 and the inertia lever 5 may be interconnected by a biased spring 6. A first leg 19 of the spring 12 may rest against a projection 13 of the inertia lever 5 in a biased manner. A second leg 20 of the spring 6 may rest against a contour 16 of the releasing lever 2 in a biased manner.

Figure 2:
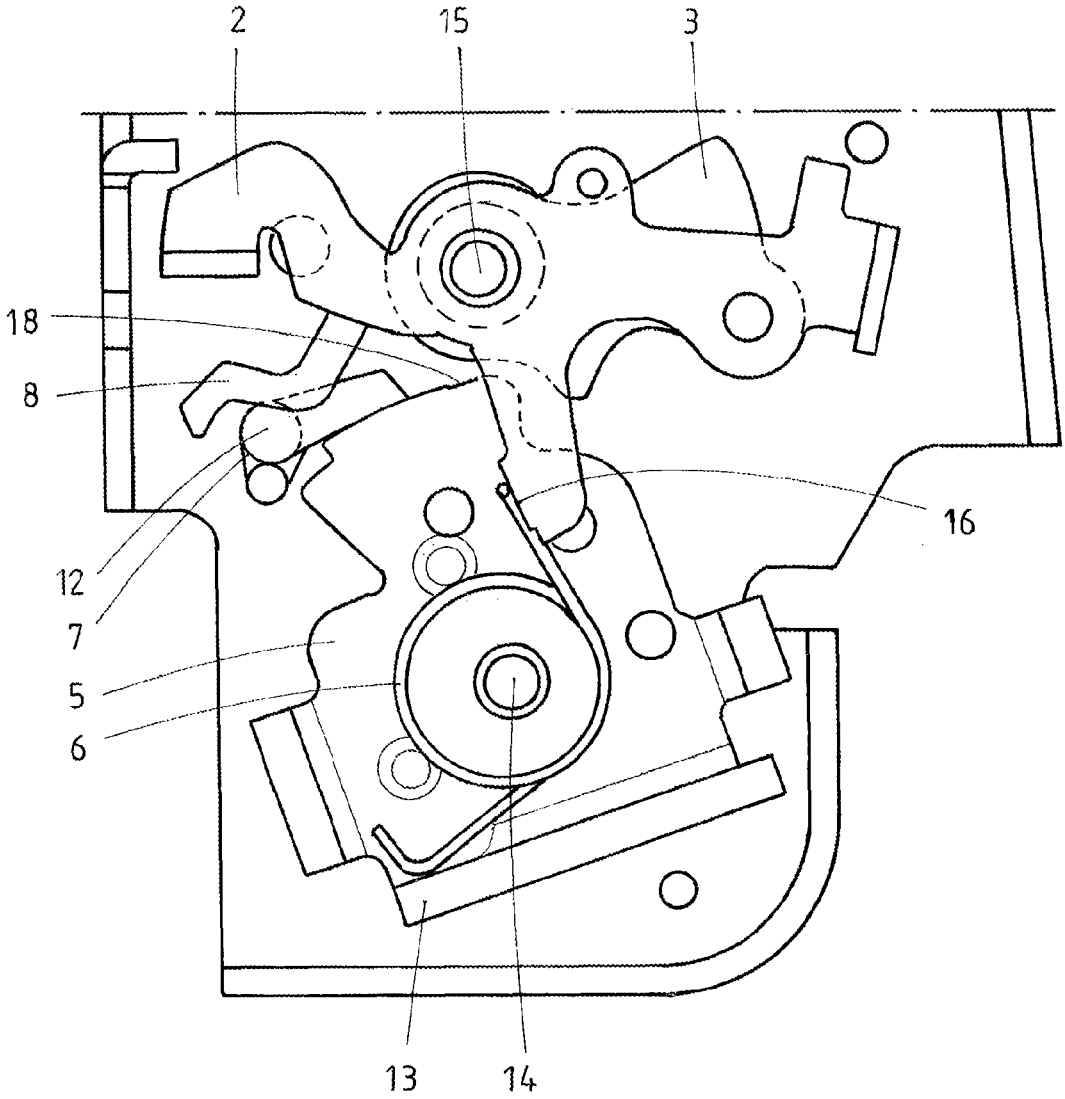
FIG. 2 illustrates a schematic view of a locking mechanism during normal operation.

Actuation of a corresponding grip of a vehicle connected to the locking mechanism results in a clockwise rotation of the releasing lever 2 as shown in FIG. 2. When the releasing lever 2 is actuated, the corresponding arm of the releasing lever 2 moves the second leg 20 of the spring 6 to the left via the contour 16. When the acceleration of the releasing lever 2 is normal, i.e. no increased or excessive acceleration occurs, the spring 6 acts as a rigid connection between the inertia lever 5 and the releasing lever 2. Accordingly, the movement of the releasing lever 2 in clockwise direction results in a substantially simultaneous movement of the inertia lever 5, in this case in counterclockwise direction around its axis 14. The arresting device is preferably configured such that during normal acceleration of the releasing lever 2 the safety lever 7 does not block the movement of the inertia lever 5. The safety lever 7 may be biased by a spring in the blocking direction, in this case in clockwise direction. To ensure a normal operation of the locking mechanism, the movement of the safety lever 7 may be configured such that the safety lever 7 does not engage with the notch 11 of the inertia lever 5 when the releasing lever 2 is actuated in an usual manner, i.e. with a normal acceleration of the releasing lever 2. Accordingly, the safety lever 7 may come into contact with a contour 18 of the inertia lever 5, thereby allowing a full travel of the inertia lever 5 as shown in FIG. 2.

Figure 3:
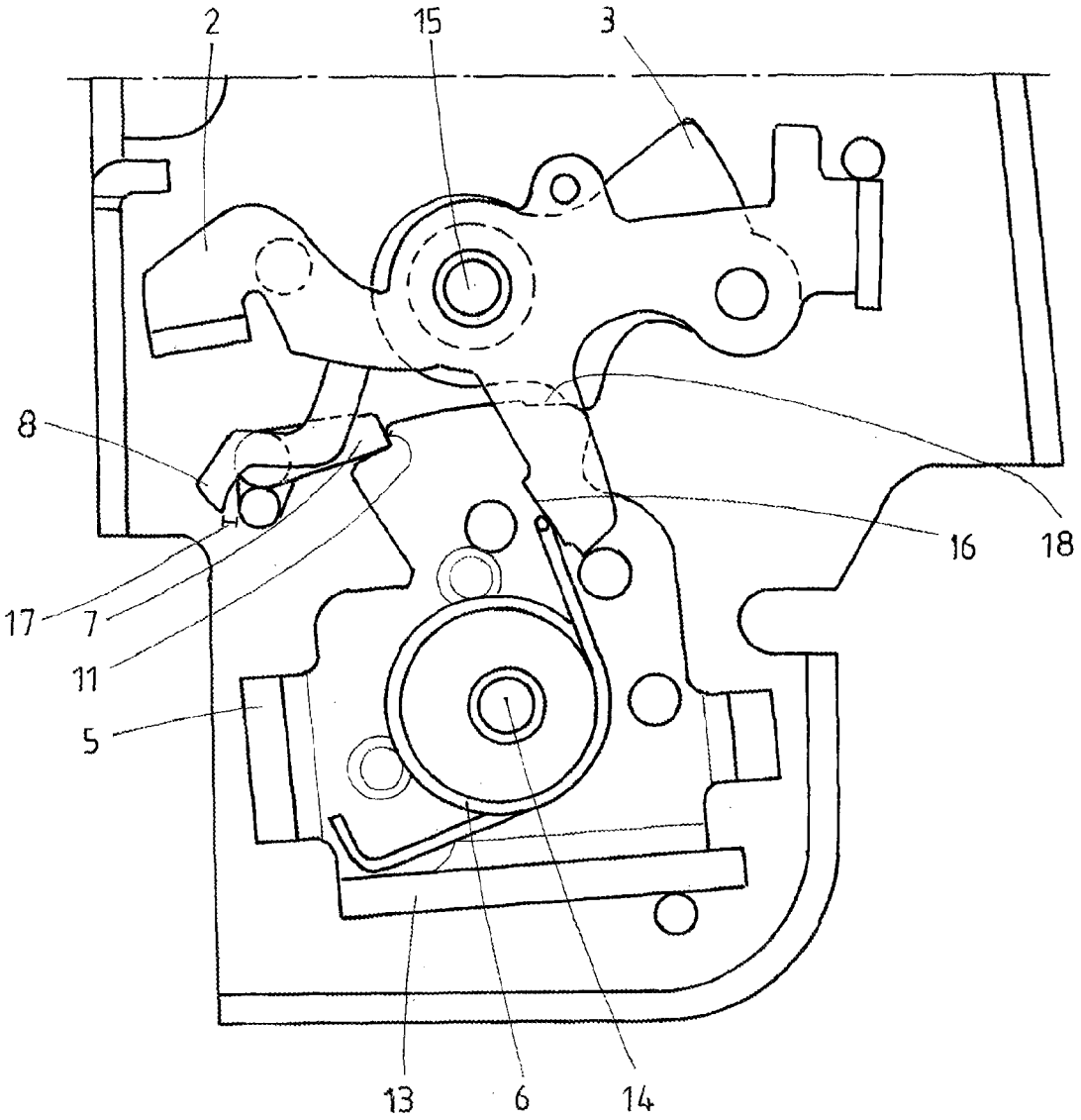
FIG. 3 illustrates a schematic view of a locking mechanism in a blocked position when the releasing lever is exposed to increased or excessive accelerations.

During motor vehicle collisions, parts of the door handle or other vehicle components may be exposed to large accelerations and cause a corresponding actuation of the grip resulting in an increased or excessive acceleration of the releasing lever 2. FIG. 3 illustrates the lock and the arresting device when increased or excessive accelerations of the releasing lever 2 occur. In this case, the spring 6 does not act as a rigid connection between the releasing lever 2 and the inertia lever 5 due to the mass of the inertia lever 5 and the related inertia effect. Accordingly, the inertia lever 5 basically stays stationary and does not rotate around its axis 14. The stationary inertia lever 5 preferably blocks the pawl 3 via the contour 18 which acts as a stopper. In addition, the safety lever 7 rotates in a clockwise direction and engages with the inertia lever 5 via the notch 11 to reach a blocking position as shown in FIG. 3.

The blocking by the safety lever 7 prevents a further movement of the inertia lever 5, for example, caused by a bouncing releasing lever 2 or the tension of the spring 6. In the meantime, the contour 18 of the inertia lever 5 acts as a stopper for the pawl 3. The pawl 3 therefore remains in the catching position as described above preventing an unintended opening of the locking mechanism.

In addition, the releasing lever 2 may comprise an arm 8 for engagement with the safety lever 7 and in particular the pin 10 of the safety lever 7. When the releasing lever 2 returns to the rest position as shown in FIG. 1, the arm 8 may carry the pin 10 of the safety lever 7 to release the blocking position of the safety lever 7. This resets the safety lever 7 so that the inertia lever 5 is free to rotate and the locking mechanism may be opened in the usual manner as described in connection with FIG. 2.

The arresting device is preferably configured such that the interface between the releasing lever 2 and the safety lever 7 has a gap 17 when the safety lever 7 is in the blocking position as shown in FIG. 3. In this case, the gap 17 is arranged between the arm 8 and the pin 10 of the safety lever 7. The gap 17 may be dimensioned to allow for a predefined movement of the releasing lever 2 without affecting the safety lever 7 and thereby releasing the blocking position. This is particularly expedient as a bouncing movement of the releasing lever 2, for example, in connection with a crash and subsequent impacts, does not adversely affect the engagement between the safety lever 7 and the notch 11 of the inertia lever 5, thereby enabling a secure blocking position of the safety lever 7.

An advantage of the lock of the present invention is that it reliably prevents an unintended opening of the lock caused, for example, by crashes or impacts. A further benefit of the lock is its compact arrangement with the reduced number of components. Moreover, the arresting device provides for a reliable blocking position which can only be released with the releasing lever returning to its initial rest position. In particular, bouncing movements of the releasing lever do not adversely affect the functioning of the arresting device. A further advantage is that the reduced rotation of the inertia lever in the blocked position provides for an improved pawl engagement with the rotary catch of the locking mechanism.

What is claimed is:

1. A lock for a motor vehicle comprising:

a locking mechanism with a rotatably mounted rotary catch for receiving a locking bolt, and a pawl with which the rotary catch can be engaged for retaining the locking bolt;

a releasing lever for placing the locking mechanism in a disengaged state; and an arresting device for preventing the disengaged state of the locking mechanism when increased or excessive accelerations of the releasing lever occur, wherein the arresting device is releasable with a return of the releasing lever to an initial rest position;

wherein the arresting device comprises an inertia lever and wherein the inertia lever and the releasing lever are interconnected in such a way that the inertia lever is moved by the releasing lever only when the releasing lever is accelerated in a usual manner with a normal acceleration;

wherein the inertia lever is configured to block the pawl for preventing the disengaged state of the locking mechanism by a contour of the inertia lever which acts directly against the pawl as a stopper for the pawl; and wherein the arresting device comprises a leg spring which provides the interconnection between the inertia lever and the releasing lever such that the inertia lever is moved by the releasing lever only when the releasing lever is accelerated in the usual manner with the normal acceleration;

the leg spring comprising a central portion that wraps around a rotation axis of the inertia lever, with one leg extending from the central portion and attached to the inertia lever, and another leg extending from the central portion and attached to the releasing lever.

2. The lock of claim 1, wherein the another leg of the spring rests against an outermost contour of the releasing lever in a biased manner in the initial rest position.

3. The lock of claim 1, wherein the arresting device comprises a safety lever that is moveable into a blocking position for blocking the inertia lever and wherein the safety lever is biased in a blocking direction.

4. The lock of claim 3, wherein the safety lever is movable into the blocking position which blocks movement of the inertia lever when the releasing lever is moved with the increased or excessive acceleration.

5. The lock of claim 3, wherein the arresting device is configured such that the safety lever does not reach the blocking position when the releasing lever is accelerated in the usual manner with the normal acceleration.

6. The lock of claim 3, wherein the releasing lever is configured for engagement with the safety lever via an arm of the releasing lever.

7. The lock of claim 3, wherein the safety lever is releasable from the blocking position by engagement with an arm of the releasing lever when the releasing lever is moved to the initial rest position.

8. The lock of claim 3, wherein the inertia lever has a notch or recess for engagement with the safety lever.

9. The lock of claim 3, wherein the releasing lever and the safety lever are arranged such that an interface between both has a gap when the safety lever is in the blocking position.

10. The lock of claim 1, wherein the mass of the inertia lever is several times larger than the mass of the spring.

11. The lock of claim 1, wherein the rotary catch is capable of introducing an opening moment into the pawl when the pawl is in a catching position in which the rotary catch can be engaged for retaining the locking bolt.

12. The lock of claim 1, wherein the one leg of the leg spring rests against a surface of a raised projection of the inertia lever in a biased manner in the initial rest position of the releasing lever.

* * * * *